United States Patent [19]

Fender

[11] Patent Number: 4,885,970

[45] Date of Patent: Dec. 12, 1989

[54] MOISTURE-FREE ELECTROMAGNETIC PICKUP FOR AN ELECTRICAL MUSICAL INSTRUMENT OF THE STRINGED TYPE

[76] Inventor: C. Leo Fender, 1510 Dana Pl., Fullerton, Calif. 92635

[21] Appl. No.: 81,630

[22] Filed: Jul. 31, 1987

Related U.S. Application Data

[63] Continuation of Ser. No. 801,475, Nov. 25, 1985, abandoned.

[51] Int. Cl.[4] ..... G10H 3/00; B05D 5/12

[52] U.S. Cl. ..... 84/1.15; G10H/3/00; B05D/5/12

[58] Field of Search ..... 427/443, 116, 127; 84/1.15, 1.16

[56] References Cited

U.S. PATENT DOCUMENTS

| | | | |
|---|---|---|---|
| 210,987 | 12/1878 | Brooks | 427/116 |
| 536,319 | 3/1895 | Schneller et al. | 427/116 |
| 1,210,722 | 1/1917 | Sultzer | 427/116 |
| 1,697,134 | 1/1929 | Neely | 427/116 |
| 3,147,332 | 9/1964 | Fender | 84/1.15 |
| 4,115,175 | 9/1978 | Yamashita et al. | 427/116 |
| 4,261,097 | 4/1981 | Weisse | 427/116 |
| 4,283,982 | 8/1981 | Armstrong | 84/1.15 |

*Primary Examiner*—Janyce Bell

*Attorney, Agent, or Firm*—Spensley Horn Jubas & Lubitz

[57] ABSTRACT

A pickup assembly for an electrical musical instrument is dipped in a hot wax bath in order to remove air pockets from the assembly. The resultant assembly provides consistent tonal characteristics despite humidity changes.

5 Claims, 1 Drawing Sheet

MOISTURE-FREE ELECTROMAGNETIC PICKUP FOR AN ELECTRICAL MUSICAL INSTRUMENT OF THE STRINGED TYPE

This is a continuation of copending application Ser. No. 801,475 filed on Nov. 25, 1985 now abandoned.

BACKGROUND OF THE INVENTION

1. Field of the Invention

The present invention relates to an electromagnetic pickup for an electrical musical instrument of the stringed type, and more particularly, to an electromagnetic pickup having consistent tonal qualities.

2 Description of the Prior Art

The present invention relates broadly to electrical musical instruments of the stringed type. It is typically applicable to an electric guitar or bass guitar or similar musical instrument having a plurality of stretched strings extending across the body and the neck, between the head of the instrument and the bridge assembly connected to the body.

In order to derive an output from such an electric guitar, bass guitar or other similar electrical musical instrument, the instrument is conventionally provided with an electromagnetic pickup comprising a number of magnetic elements or pole pieces having wound therearound a conductive coil. Typically, one pole piece is disposed directly beneath each string of the instrument. The strings are constructed of a magnetizable substance such as steel and therefore become part of the conductive path for the magnetic lines of flux of the pole pieces. Accordingly, when any of the strings are caused to vibrate, this causes a disturbance in the magnetic field of the associated pole piece. This has the effect of generating a voltage in the conductive coil, which voltage may be suitably amplified and transmitted to a loudspeaker system.

The coil assembly is typically wrapped around a bobbin made of a nylon, ABS or other plastic material. The pole pieces are positioned within holes in the bobbin unit. The pickup is thus a unitary assembly which is secured to the body of the guitar.

Pickup assemblies of the type described generally provide good tonal quality. Numerous variations, such as the inclusion of a "humbucking" assembly or the use of pole pieces which are offset from the strings, have been provided to further increase the sound quality produced by the pickup. Despite numerous improvements, many assemblies are hampered by inconsistent sound quality. It is therefore an object of the present invention to provide an electromagnetic pickup assembly having consistent sound quality under variable operating conditions.

SUMMARY OF THE INVENTION

The inventor has determined that variation in tonal quality of pickup assemblies is due in part to the accumulation of moisture in the assembly. Since water is a conductor, the presence of water within the pickup assembly can alter the magnetic circuit and thus the tonal characteristics provided by the pickup. Pockets in which moisture may collect may be located in pores in the plastic bobbin itself as well as in spaces between components of the assembly. The present invention is directed to a method of manufacturing a pickup assembly by which pockets in which moisture may be accumulated are eliminated from the assembly, thereby resulting in a pickup whose tonal characteristics are consistent regardless of humidity changes which would otherwise result in moisture being collected in the assembly. After the pickup has been assembled, the entire unit is dipped into a bath of wax and boiled until no further air bubbles are released from the pickup. This ensures that all air pockets in the assembly are filled with wax and are not susceptible to taking on moisture.

BRIEF DESCRIPTION OF THE DRAWINGS

The invention will be described with reference to the accompanying drawings wherein.

DESCRIPTION OF THE PREFERRED EMBODIMENT

The following description is of the best presently contemplated mode of carrying out the invention. This description is made for the purpose of illustrating the general principles of the invention add is not to be taken in a limiting sense. The scope of the invention is best determined by reference to the appended claims.

Figure 1:
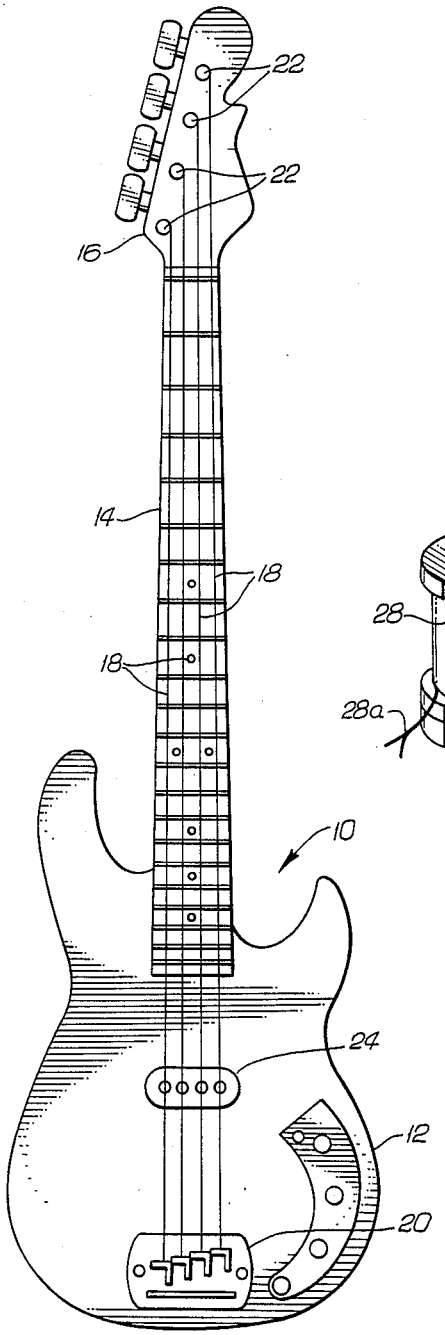
FIG. 1 is a top plan view of an electric bass guitar showing a pickup assembly.

Referring to FIG. 1, an electric bass guitar 10 includes a body 12, a neck 14 and a head 16. Strings 18 are stretched between a bridge assembly 20 and string posts 22 located on the head 16. A pickup assembly 24 is secured to the body 12 underneath the strings 18.

Figure 2:
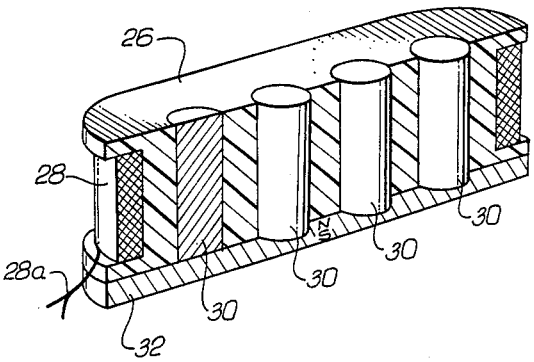
FIG. 2 is a perspective sectional view of a pickup assembly.

The structure of the pickup assembly is shown in FIG. 2. A plastic, e.g., nylon or ABS, bobbin 26 has a copper coil 28 wrapped around it, with leads **28*a* extending from the bobbin. Conductive pole pieces 30 are held within openings in the center of the bobbin, with the coil 28 surrounding the pole pieces. A permanent magnet 32** is positioned adjacent the bottom of the bobbin and may be secured to the bobbin by means of a base plate (not shown).

In order to derive an output from the guitar 10, the strings 18 are plucked, and the resulting vibration produces an electrical signal in the pickup assembly which may be suitably amplified and transmitted to a loudspeaker assembly. The pickup assembly forms a magnetic circuit, and moisture in the assembly can affect the electrical characteristics and thus tonal characteristics of the assembly. In order to prevent any changes in tonal characteristics caused by environmental changes, the pickup assembly is subjected to a procedure which renders it impervious to moisture. Specifically, the completed pickup assembly is dipped into a wax bath and boiled until no further air bubbles are produced in the bath. This is an indication that all air pockets in the pickup assembly have been filled with wax. In the present embodiment of the invention, variable density paraffin wax is employed; however, other kinds of wax would be acceptable. The wax serves to fill all voids in the assembly, including surface voids in the plastic bobbin as well as pockets created within the coil and between various components of the assembly.

After the assembly has been in the heated wax bath for a sufficient amount of time so that no additional air bubbles are released from the assembly, it is removed from the bath and the wax remaining on the assembly allowed to solidify. Surface wax may be cleaned off; however, wax will remain within pockets in the pickup assembly, thereby preventing moisture from collecting in the pockets. The pickup assembly will thus provide consistent tonal qualities regardless of humidity variations, since moisture content in the pickup assembly will remain at a fixed minimal level. Thus, by the addition of a simple step to the manufacturing process, a pickup assembly can be provided which achieves substantially more consistent tonal quality than prior art assemblies.

What is claimed is:

1. A method of making a pickup assembly for an electrical musical instrument of the stringed type, comprising the steps of:

providing a pickup assembly for an electrical musical instrument, the pickup assembly comprising a housing, a bobbin formed of a plastic material, a coil wrapped around the bobbin, and a plurality of pole pieces passing through the bobbin and surrounded by the coil;

placing the pickup assembly in a bath of heated liquid wax to fill voids in the pickup assembly with the wax; and removing the pickup assembly from the bath and allowing the wax to solidify, thereby preventing moisture from getting trapped in the pickup assembly.

2. The method of claim 1 wherein the wax is a paraffin wax.

3. The method of claim 1 wherein the step of placing the pickup assembly in a heated bath includes the step of holding the pickup assembly in the wax bath until the assembly produces no air bubbles, thereby indicating that substantially all air pockets in the assembly have been filled with wax.

4. A pickup assembly for an electrical musical instrument produced in accordance with the method of claim 1.

5. A pickup assembly for an electrical musical instrument having a bobbin formed of a plastic material, a coil wrapped around the bobbin, and a plurality of pole pieces passing through the bobbin and surrounded by the coil, wherein the entire assembly is completely encased in a wax coating.

* * * * *